US011268339B2

(12) United States Patent
Butler et al.

(10) Patent No.: US 11,268,339 B2
(45) Date of Patent: Mar. 8, 2022

(54) GUIDED WASH PIPE MILLING

(71) Applicant: Halliburton Energy Services, Inc., Houston, TX (US)

(72) Inventors: Benjamin Luke Butler, Conroe, TX (US); Aihua Liang, Plano, TX (US); Loc Phuc Lang, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/915,092

(22) Filed: Jun. 29, 2020

(65) Prior Publication Data

US 2021/0404279 A1 Dec. 30, 2021

(51) Int. Cl.
*E21B 29/06* (2006.01)

(52) U.S. Cl.
CPC ..... *E21B 29/06* (2013.01)

(58) Field of Classification Search
CPC ..... E21B 29/06
See application file for complete search history.

(56) References Cited

U.S. PATENT DOCUMENTS 3,397,746 A 8/1968 Link
4,616,721 A * 10/1986 Furse ..... E21B 31/16 294/86.18
5,123,489 A * 6/1992 Davis ..... E21B 29/00 166/377
5,199,513 A * 4/1993 Stewart ..... E21B 29/06 175/73
5,301,760 A 4/1994 Graham
5,881,816 A * 3/1999 Wright ..... E21B 31/16 166/376
5,887,655 A 3/1999 Haugen et al.
5,944,101 A 8/1999 Hearn
6,024,168 A * 2/2000 Kuck ..... E21B 29/06 166/297
6,112,812 A 9/2000 Carter
6,123,150 A 9/2000 McGarian
(Continued)

FOREIGN PATENT DOCUMENTS

WO 2003083250 A1 10/2003
WO 2016209686 12/2016
WO 2018140143 8/2018

OTHER PUBLICATIONS

Abraham et al., "Integrated Services Achieves Multi-String Casing Exit and Re-Drill in Geothermal Well", GRC Transactions, vol. 36, 2012 (see pp. 1250-1251).

(Continued)

*Primary Examiner* — Taras P Bemko
(74) *Attorney, Agent, or Firm* — McGuireWoods LLP

(57) ABSTRACT

Methods and apparatus for milling a window for a lateral wellbore in a casing string. An example method introduces a milling assembly into a primary wellbore, the milling assembly comprising: a whipstock, a guide bar coupled to the whipstock, and a wash pipe coupled to the guide bar. The method further includes running the milling assembly to a depth at which it is adjacent to the window in the casing string; securing the whipstock in the casing string; decoupling the wash pipe from the guide bar; guiding the wash pipe to mill the guide bar without milling the whipstock; and milling the window in the casing string with the wash pipe.

20 Claims, 4 Drawing Sheets

(56) References Cited

U.S. PATENT DOCUMENTS

| | | | | |
|---|---|---|---|---|
| 9,915,098 | B2 | 3/2018 | Alsup et al. | |
| 10,082,003 | B2 | 9/2018 | Sheehan et al. | |
| 2011/0253376 | A1* | 10/2011 | Krpec | E21B 37/00 166/311 |
| 2013/0277040 | A1 | 10/2013 | Steele | |
| 2014/0116705 | A1* | 5/2014 | Broussard | E21B 37/00 166/305.1 |
| 2018/0258738 | A1* | 9/2018 | Ian | E21B 43/045 |
| 2020/0032604 | A1 | 1/2020 | Al-Ramadhan | |

OTHER PUBLICATIONS

International Search Report and Written Opinion issued in corresponding International Patent Application No. PCT/US2020/040506; dated Mar. 18, 2021.

* cited by examiner

GUIDED WASH PIPE MILLING

TECHNICAL FIELD

The present disclosure relates generally to wellbore operations, and more particularly, to the use of a guide bar for guiding the wash pipe milling of a lateral window in a multilateral well completion.

BACKGROUND

A multilateral well completion may include a primary wellbore extending vertically or horizontally in a subterranean formation. A casing string may be disposed in the wellbore. In some examples, a layer of cement may be disposed in the annulus between the casing string and the inside diameter of the primary wellbore. An exit window in the casing string may be used for drilling a lateral or secondary wellbore from the primary wellbore.

During the milling operation for the lateral wellbore, the deflection of the milling tool is necessary to orient the milling tool from the primary wellbore into the desired lateral window.

A whipstock may be installed within the primary wellbore at a location adjacent to the preselected exit window for the desired lateral wellbore. The surface of the whipstock is tapered toward the window to provide a transition surface to orient the milling tool toward the window for the desired lateral wellbore. Provided are improvements to wellbore milling operations, through the use of a guide bar for guiding the wash pipe milling of a lateral window in a multilateral well completion.

BRIEF DESCRIPTION OF THE DRAWINGS

Illustrative examples of the present disclosure are described in detail below with reference to the attached drawing figures, which are incorporated by reference herein, and wherein.

Figure 1:
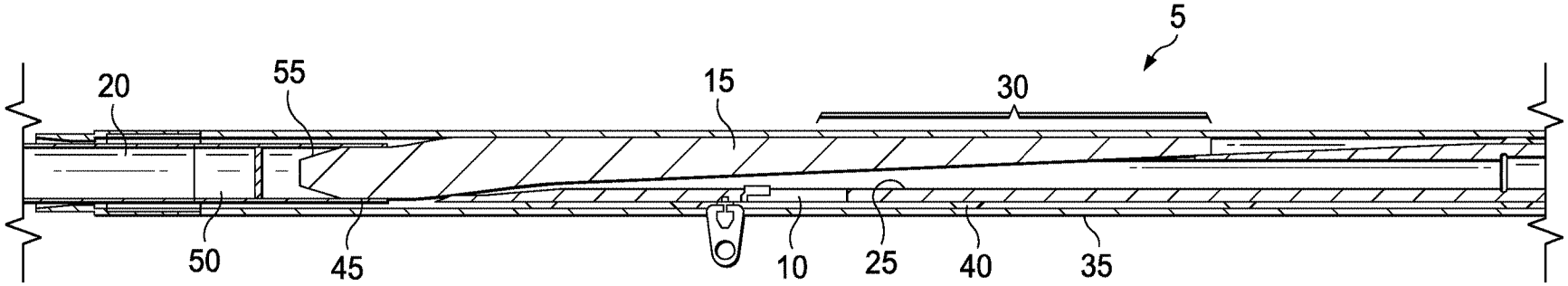
FIG. 1 is a cross-section illustration of an example lateral wellbore milling assembly in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a guide bar for guiding the wash pipe milling of a lateral window in a multilateral well completion.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

As used herein, the term "formation" encompasses the term "reservoir," referring to a portion of the formation which has sufficient porosity and permeability to store or transmit fluids (e.g., hydrocarbons). As used herein, the term "fracturing fluid" refers generally to any fluid that may be used in a subterranean application in conjunction with a desired function and/or for a desired purpose. The term "fracturing fluid" does not imply any particular action by the fluid or any component thereof.

The examples described herein relate to the use of a guide bar for guiding the wash pipe milling of a lateral window in a multilateral well completion. The guide bar is coupled to a whipstock at the deflection surface of the whipstock. The wash pipe is coupled to the guidebar. The assembly of the guide bar, wash pipe, and whipstock are introduced into the wellbore together and run into the well in a single trip. When at the desired wellbore depth that is adjacent to the target exit window, the whipstock may be secured in the casing string. The wash pipe may then be decoupled from the guide bar and guided by the milling of the guide bar to the exit window in the desired orientation. The deflection surface of the whipstock is not milled as the guide bar guides the wash pipe to the window. The guide bar maintains its coupling to the whipstock until the guide bar is milled. Advantageously, the lateral milling operation is conducted in a single trip with the setting of the whipstock and the subsequent milling of the window occurring without the need for removal or insertion of any additional wellbore tools. As a further advantage, the wash pipe catches and retrieves the milled sections of the casing string which may greatly reduce the amount of debris left behind in the wellbore. An additional advantage is that the guide bar guides the wash pipe to cut the window straight. One more advantage is that the guide bar protects the whipstock from being milled by the wash pipe.

FIG. 1 illustrates a cross-sectional view of a lateral wellbore milling assembly 5. The lateral wellbore milling assembly 5 comprises a whipstock 10, a guide bar 15, and a wash pipe 20. The whipstock 10 may be any species of whipstock useful for orienting and deflecting the drilling of a lateral wellbore off of a primary wellbore in a multilateral well completion. The whipstock 10 comprises a deflection surface 25. The deflection surface 25 deflects the drilling equipment when the drilling of the lateral wellbore is to commence after the milling of the exit window 30 in the casing sting 35. The exit window 30 is a window in the casing string 35 that may be targeted for milling and may comprise a portion of the casing string 35 designed to be easily milled relative to the remainder of the casing string 35 as would be readily apparent to one of ordinary skill in the art. For example, the exit window 30 portion of the casing string 35 may comprise materials that are easily milled. The deflection surface 25 of the whipstock 10 may guide the milling tool to the exit window 30 so as to be milled. The deflection surface 25 should not be milled as it must be intact to deflect and direct the drilling of the lateral window through the exit window 30. In some examples, the exit window 30 portion of the casing string 35 is not premilled and/or does not require a pilot hole for milling.

With continued reference to FIG. 1, the lateral wellbore assembly 5 may be introduced into the wellbore as illustrated with the whipstock 10 coupled to the guide bar 15, and the guide bar 15 coupled to the wash pipe 20. When the lateral wellbore assembly 5 reaches the desired wellbore depth to which it will be adjacent to the target exit window 30, the whipstock 10 may be latched or otherwise coupled and set in the casing string 35 via setting mechanism 40. When the whipstock 10 is set, the wash pipe 20 may be decoupled from the guide bar 15. The coupling mechanism between the wash pipe 20 and the guide bar 15 is designed to be easier to decouple than the coupling mechanism between the guide bar 15 and the whipstock 10. As such, the wash pipe 20 may be decoupled from the guide bar 15 without decoupling the guide bar 15 from the whipstock 10. In some examples, the guide bar 15 may be coupled to the wash pipe 20 with a severable connection such as shear screws, shear pins, or any such severable coupling mechanism. In other examples, the guide bar 15 may be coupled to the wash pipe 20 with an actuatable mechanism such as a hydraulic or pneumatic mechanism. If using an actuatable mechanism, the mechanism may be actuated after the whipstock 10 has been set in the casing string 35.

After the wash pipe 20 has been decoupled from the guide bar 15, the wash pipe 20 may begin the milling operation. As illustrated in the cross-section of FIG. 1, a terminal end 55 of the guide bar 15 is chamfered and fit within the mill 50 of the wash pipe 20. The chamfer guides the cutting surface 45 of the mill 50 and ensures that the wash pipe 20 slides onto the guide bar 15. The cutting surface 45 of the mill 50 may rotate with the wash pipe 20 to begin the milling of the guide bar 15. The milling of the guide bar 15 guides the wash pipe 20 milling towards the exit window 30 where it may mill the exit window 30 in the casing string 35.

As the mill 50 mills the guide bar 15, the wash pipe 20 is guided towards the exit window 30 where the mill 50 begins to mill the casing string 35. The guide bar 15 is not decoupled from the whipstock 10 except as the mill 50 mills away the guide bar 15. Optionally, the guide bar 15 is offset from the whipstock 10 to lift the mill 50 and the wash pipe 20 away from the whipstock 10 and thereby further reduce the possibility of contact between the cutting surface 45 of the mill 50 and the deflection surface 25 of the whipstock 10. After the exit window 10 is successfully milled, the washpipe 10 may be removed if desired.

Figure 2:
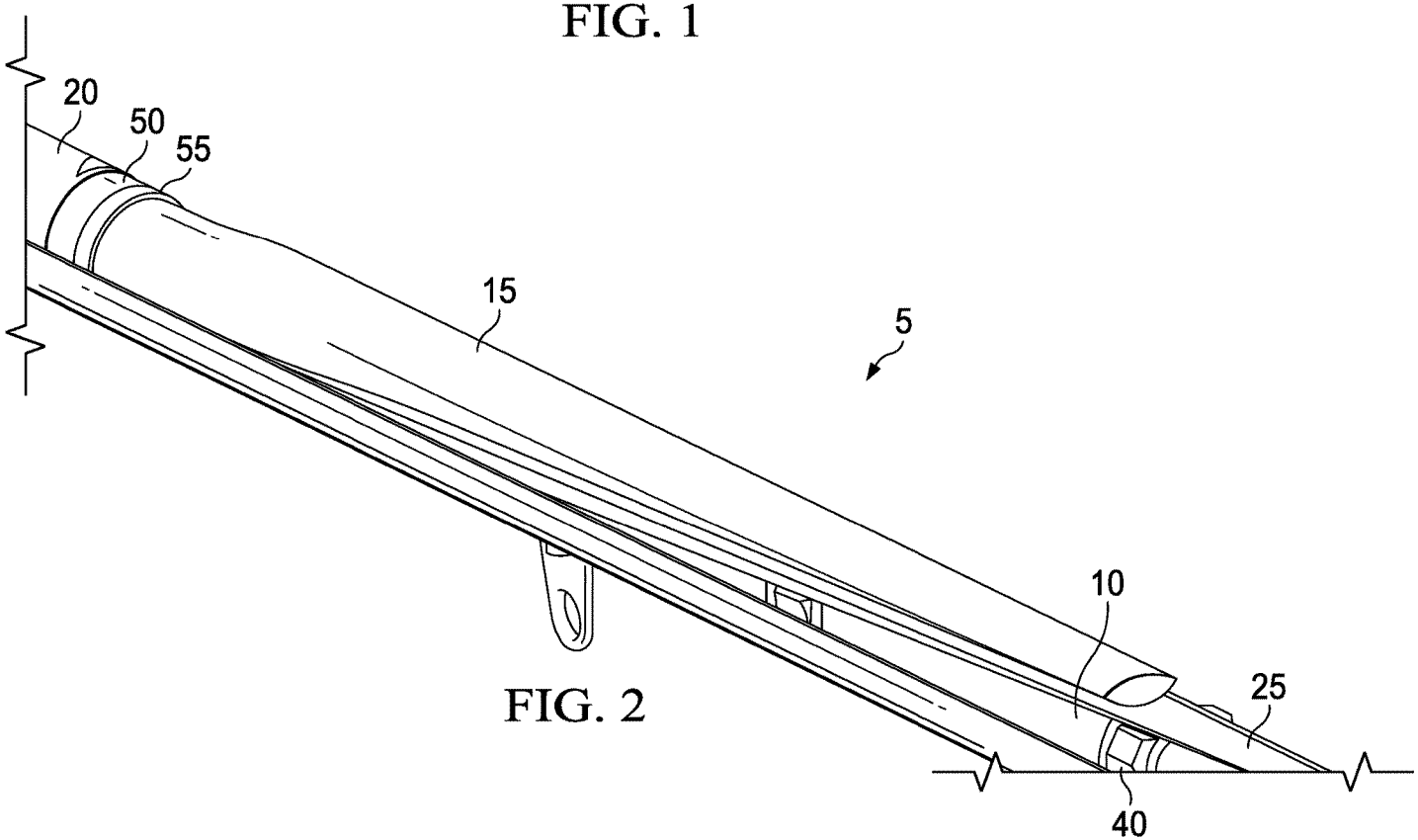
FIG. 2 is an isometric illustration of the example lateral wellbore milling assembly in accordance with one or more examples described herein.

FIG. 2 illustrates an isometric view of the lateral wellbore milling assembly 5. As illustrated, the guide bar 15 is shaped so as to decrease in diameter as it extends from the terminal end adjacent to the mill 50 down to the opposing terminal end. The tapering of the diameter of the guide bar 15 allows the guide bar 15 to be run in the wellbore while adjacent to the whipstock 10 so that the entirety of the lateral wellbore milling assembly 5 may be run in the well in one trip.

The guide bar 15 may comprise any material sufficient for milling with the wash pipe 20. Examples of potential guide bar 10 materials may include, but are not limited to, any metal or metal alloy (e.g., low alloy steel such as American Iron and Steel Institute (AISI) alloys 4140, 4130, etc.) having a material yield strength equal or less than the whipstock material. With the benefit of this disclosure, one of ordinary skill in the art will be readily able to provide a guide bar 10 sufficient for milling with the wash pipe 20.

Figure 3:
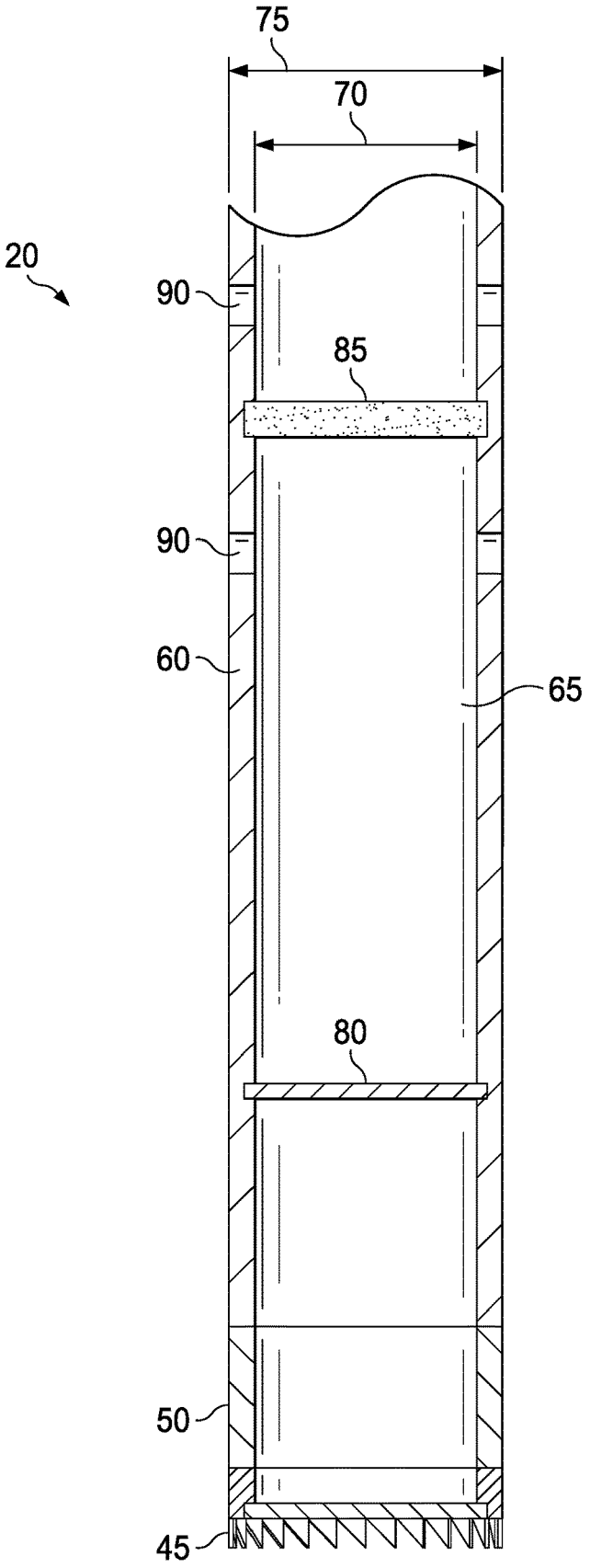
FIG. 3 is a photograph illustrating the interior portions of the wash pipe of the lateral wellbore milling assembly in accordance with one or more examples described herein.

FIG. 3 illustrates a cross-section of the washpipe 20 that houses the retaining mechanisms for retaining cuttings and debris within the washpipe 20. The washpipe 20 generally comprises a tubular-shaped body 60 with an annulus 65, and inner diameter 70, and an outer diameter 75. The body 60 comprises an opening 75 at the mill 50 end disposed adjacent to the cutting surface 45. Although only one cutting surface 45 is depicted, additional cutting surfaces disposed around the inner diameter 70 may be provided in some examples.

The washpipe 20 further comprises a retaining element 80 positioned within the body 60 along a portion of the inner diameter 70 and uphole of the opening 75. Although only one retaining element 80 is illustrated, it is to be understood that more than one retaining element 80 may be used in some alternative examples. Optionally, a filter 85 may be positioned within the body 60 uphole of the retaining element 80 and the opening 75. When there is no fluid circulation through the annulus 65, the retaining element 80 is closed. When there is fluid circulation through the annulus 65, the retaining element is open. As such, the retaining element 80 closes and entraps cuttings and debris when said cuttings and debris pass uphole of it and fluid circulation is halted thereby closing the retaining element 80. The retaining element 80 may be actuated by spring-loaded, hydraulic, pneumatic, electronic, or other such mechanism sufficient to force the retaining element 80 into a closed position when fluid circulation is halted. The retaining element 80 may be used to retain portions or of the casing string (i.e., casing string 35 as illustrated in FIG. 1) after the mill 50 of the washpipe 20 has milled an opening in the exit window and there is no longer any circulation of the fluid through the annulus 65 of the body 60. Moreover, because of the nature of the washpipe 20 milling, larger-sized cuttings are generated. The larger-sized cuttings are more easily retained within the washpipe 20 which results in more of the cuttings being retained by the retaining element 80. This also results in reduced cleanup and a reduction in the risk of cutting build-up that could potentially interfer with the cutting surface 45.

In optional embodiments, the filter 85 may be used to trap cuttings during operation of washpipe 20 when there is fluid circulation through the annulus 65 of the body 60. In further optional embodiments, openings 90 may be disposed within the body 60 at desired locations to allow fluid circulation therethrough. These openings 90 may be actuatable to be open and closed in some further optional examples.

It is to be understood that the lateral wellbore milling assembly 5 and its components as depicted in FIGS. 1-3 are only one possible configuration of lateral wellbore milling assembly 5. The individual pieces of wellbore equipment may be rearranged as would be readily apparent to one of ordinary skill in the art. As such, it is to be recognized that lateral wellbore milling assembly 5 is merely exemplary in nature, and various additional configurations may be used that have not necessarily been depicted in FIGS. 1-3 in the interest of clarity. Moreover, non-limiting additional components may be present, including, but not limited to, valves, condensers, adapters, joints, gauges, sensors, compressors, pressure controllers, pressure sensors, flow rate controllers, flow rate sensors, temperature sensors, and the like. As such, it should be clearly understood that the example illustrated by FIGS. 1-3 is merely a general application of the principles of this disclosure in practice, and a wide variety of other examples are possible. Therefore, the scope of this disclosure is not limited in any manner to the details of FIGS. 1-3 as described herein.

The lateral wellbore milling assembly 5 described herein may be used to mill an opening for a lateral wellbore. The opening for the lateral wellbore may be formed by milling and/or drilling through a section of casing string 35, the cement liner (if present), and/or the formation.

Figure 4:
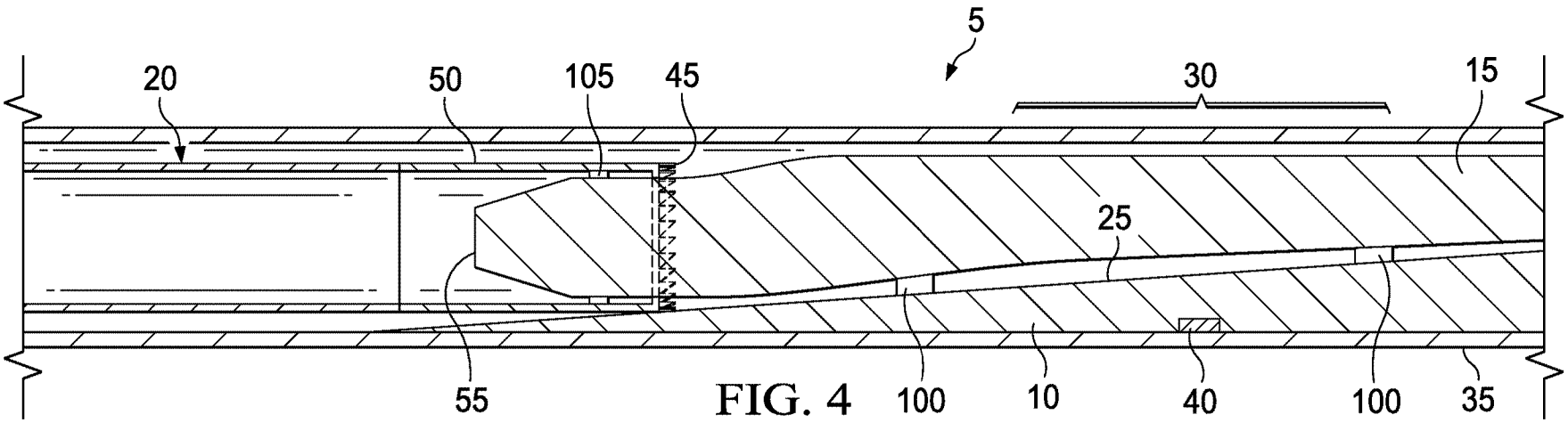
FIG. 4 is a cross-section illustrating the milling of a lateral wellbore with the lateral wellbore milling assembly in accordance with one or more examples described herein.

Referring now to FIG. 4, a cross-sectional view of the lateral wellbore milling assembly 5 is illustrated as the whipstock 10 is set within the section of casing string 35. The lateral wellbore milling assembly 5 may be lowered on a drilling string in a wellbore partially lined with the section of casing string 35 and, optionally, a cement liner. As the lateral wellbore milling assembly 5 is lowered, it may be rotated before or during engagement with the targeted section of the casing string 35 adjacent the desired exit window 30. When in the desired orientation and depth, the lateral wellbore milling assembly 5 may be set in place by setting mechanism 40 which couples the whipstock 10 to the casing string 35. The exit window 30 may comprise materials more desirable for milling such as aluminum in some examples. In some examples, a pilot hole is not milled before introduction of the lateral wellbore milling assembly 5. In other examples, the exit window 30 is not pre-milled.

With continued reference to FIG. 4, the whip stock 10 is set in the casing string 35 via the setting mechanism 40 described above. Coupling mechanism 100 maintains the connection between the guide bar 15 and the whip stock 10. Coupling mechanism 105 maintains the connection between the guide bar 15 and the wash pipe 20.

Figure 5:
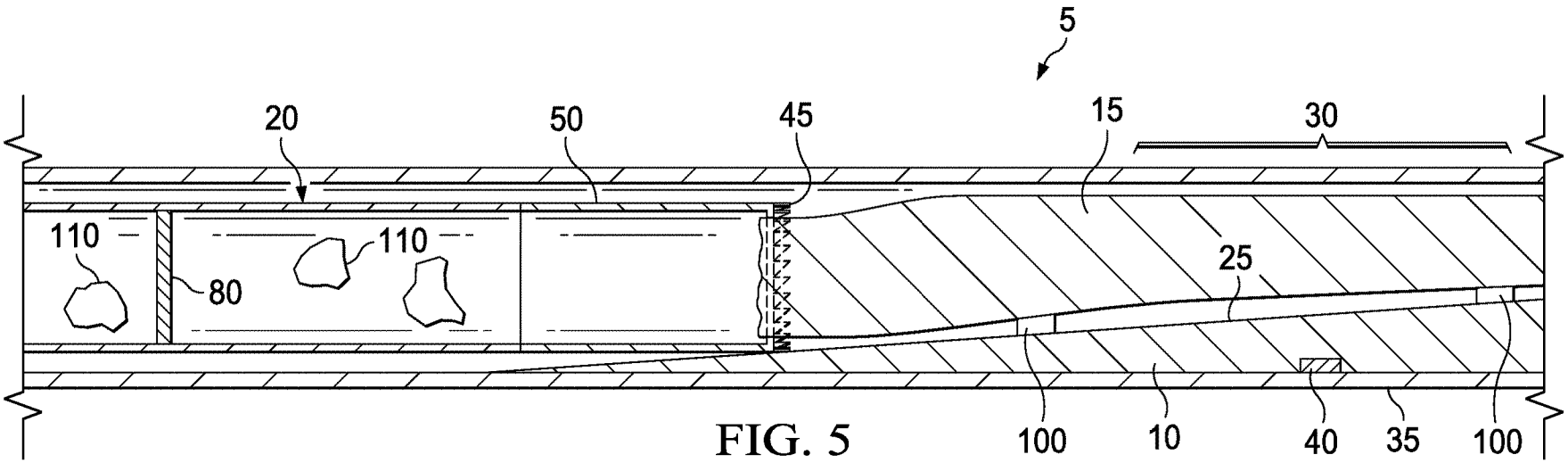
FIG. 5 is a cross-section further illustrating the milling of a lateral wellbore with the lateral wellbore milling assembly in accordance with one or more examples described herein.

With reference to FIG. 5, the coupling mechanism 105 (illustrated in FIG. 4) is severed and the wash pipe 20 has begun to mill the guide bar 15 with the mill 50 portion which comprises the cutting surface 45. The coupling mechanism 100 between the guide bar 15 and the whipstock 10 is still intact. The guide bar 15 is offset from the deflection surface 25 of the whipstock 10. The wash pipe 20 is rotated and the cutting surface 45 of the mill 50 begins to mill the guide bar 15. During milling and/or drilling operations, a fluid (e.g., drilling fluid) may be circulated through the wash pipe 20. The fluid may carry cuttings 110 and other debris through the wash pipe 20. The fluid may carry the cuttings 110 past the retaining element 80 which may catch and retain the cuttings 110 when fluid circulation is lost in the wash pipe 20.

With continued reference to FIG. 5, as the guide bar 15 is milled by the wash pipe 20, the wash pipe 20 is guided toward the exit window 30 of the casing string 35 without the cutting surface 45 of the wash pipe 20 contacting the deflection surface 25 of the whip stock 10.

Figure 6:
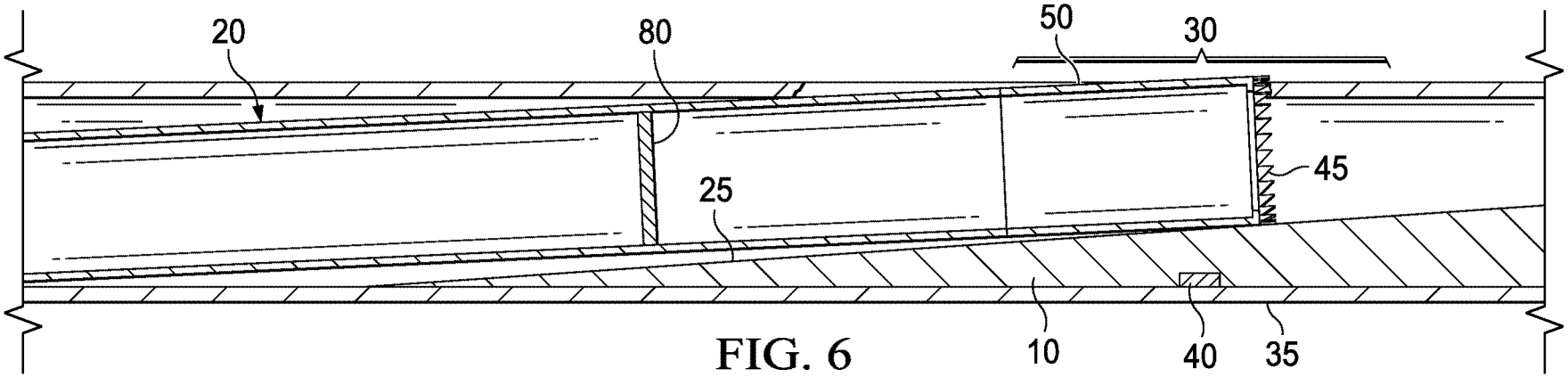
FIG. 6 is a cross-section further illustrating the milling of a lateral wellbore with the lateral wellbore milling assembly in accordance with one or more examples described herein.

FIG. 6 illustrates the wash pipe 20 as it mills through the portion of casing string 35 comprising the exit window 30. The guide bar 15 illustrated in FIGS. 4-5 has been milled away as the wash pipe 20 was guided into the exit window 30. In some examples, the wash pipe 20 may mill the casing string 35, a cement sleeve (not illustrated), and/or a portion of the adjacent subterranean formation (not illustrated). After the exit window 30 has been milled the lateral wellbore may be further drilled and completed.

During circulation of the fluid through the wash pipe 20, the cuttings 110 (illustrated in FIG. 5) and other debris may be filtered within the wash pipe 20 by the filter 85 described in FIG. 3 above. Further, the cuttings 110 and other debris may be retained within the wash pipe 20 by the retaining element 80 when the retaining element 80 is in the closed position after the fluid stops circulating through the wash pipe 20. The cuttings 110 and other debris may be retrieved from within the wash pipe 20 when the wash pipe 20 is removed from the wellbore.

It is to be recognized that the lateral wellbore milling assembly may also directly or indirectly affect the various downhole equipment and tools that may contact the lateral wellbore milling assembly disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the apparatus, methods, and systems generally described above and depicted in FIGS. 1-6.

Provided are methods for milling a window for a lateral wellbore in a casing string. An example method comprises introducing a milling assembly into a primary wellbore, the milling assembly comprising: a whipstock, a guide bar coupled to the whipstock, and a wash pipe coupled to the guide bar. The method further comprises running the milling assembly to a depth at which it is adjacent to the window in the casing string; securing the whipstock in the casing string; decoupling the wash pipe from the guide bar; guiding the wash pipe to mill the guide bar without milling the whipstock; and milling the window in the casing string with the wash pipe.

Additionally or alternatively, the method may include one or more of the following features individually or in combination. The wash pipe may be decoupled from the guide bar without decoupling the guide bar from the whipstock. The guide bar may be decoupled from the wash pipe by a severable connection comprising shear pins, shear screws, or a combination thereof. The guide bar may be decoupled from the wash pipe by a acuatable connection comprising hydraulics, penumatics, or a combination thereof. The guide bar may be offset from the whipstock. The guide bar may be coupled to the wash pipe proximate a terminal end of the guide bar, wherein said terminal end of the guide bar is chamfered. The wash pipe may comprise an internal retaining element to retain cuttings. The window may not be pre-milled and may not comprise a pilot hole. The guide bar may comprise a metal or metal alloy having a material yield strength equal or less than the whipstock material.

Provided is a lateral wellbore milling assembly. An example assembly comprises a whipstock, a guide bar coupled to the whipstock, and a wash pipe coupled to the guide bar.

Additionally or alternatively, the assembly may include one or more of the following features individually or in combination. The wash pipe may be decoupled from the guide bar without decoupling the guide bar from the whipstock. The guide bar may be decoupled from the wash pipe by a severable connection comprising shear pins, shear screws, or a combination thereof. The guide bar may be decoupled from the wash pipe by a acuatable connection comprising hydraulics, penumatics, or a combination thereof. The guide bar may be offset from the whipstock. The guide bar may be coupled to the wash pipe proximate a terminal end of the guide bar, wherein said terminal end of the guide bar is chamfered. The wash pipe may comprise an internal retaining element to retain cuttings. The window may not be pre-milled and may not comprise a pilot hole. The guide bar may comprise a metal or metal alloy having a material yield strength equal or less than the whipstock material.

Provided are systems for milling a window for a lateral wellbore in a casing string. An example system comprises a milling assembly comprising: a whipstock, a guide bar coupled to the whipstock, and a wash pipe coupled to the guide bar. The system further comprises a casing string having the milling assembly disposed therein, wherein the casing string comprises a window adjacent the milling assembly.

Additionally or alternatively, the system may include one or more of the following features individually or in combination. The wash pipe may be decoupled from the guide bar without decoupling the guide bar from the whipstock. The guide bar may be decoupled from the wash pipe by a severable connection comprising shear pins, shear screws, or a combination thereof. The guide bar may be decoupled from the wash pipe by a acuatable connection comprising hydraulics, penumatics, or a combination thereof. The guide bar may be offset from the whipstock. The guide bar may be coupled to the wash pipe proximate a terminal end of the guide bar, wherein said terminal end of the guide bar is chamfered. The wash pipe may comprise an internal retaining element to retain cuttings. The window may not be pre-milled and may not comprise a pilot hole. The guide bar may comprise a metal or metal alloy having a material yield strength equal or less than the whipstock material.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for milling a window for a lateral wellbore in a casing string, the method comprising:

introducing a milling assembly into a primary wellbore, the milling assembly comprising:

a whipstock, a guide bar coupled to the whipstock, and a wash pipe coupled to the guide bar;

running the milling assembly to a depth in the casing string at which it is adjacent to the location at which the window is desired;

securing the whipstock in the casing string;

decoupling the wash pipe from the guide bar; wherein the guide bar is decoupled from the wash pipe by an acuatable connection comprising hydraulics, pneumatics, or a combination thereof;

guiding the wash pipe to mill the guide bar without milling the whipstock; and milling the window in the casing string with the wash pipe.

2. The method of claim 1, wherein the wash pipe is decoupled from the guide bar without decoupling the guide bar from the whipstock.

3. The method of claim 1, wherein the guide bar is additionally coupled to the washpipe with a severable connection comprising shear pins, shear screws, or a combination thereof.

4. The method of claim 1, wherein the guide bar is offset from the whipstock.

5. The method of claim 1, wherein the guide bar is coupled to the wash pipe proximate a terminal end of the guide bar, wherein said terminal end of the guide bar is chamfered.

6. The method of claim 1, wherein the wash pipe comprises an internal retaining element to retain cuttings.

7. The method of claim 1, wherein the window is not pre-milled and does not comprise a pilot hole.

8. The method of claim 1, wherein the guide bar comprises a metal or metal alloy having a material yield strength equal or less than the whipstock material.

9. A lateral wellbore milling assembly comprising:

a whipstock, a guide bar coupled to the whipstock, and a wash pipe coupled to the guide bar; wherein the guide bar is coupled to the wash pipe with an acuatable connection comprising hydraulics, pneumatics, or a combination thereof.

10. The assembly of claim 9, wherein the guide bar is additionally coupled to the wash pipe with a severable connection comprising shear pins, shear screws, or a combination thereof.

11. The assembly of claim 9, wherein the guide bar is offset from the whipstock.

12. The assembly of claim 9, wherein the guide bar is coupled to the wash pipe proximate a terminal end of the guide bar, wherein said terminal end of the guide bar is chamfered.

13. The assembly of claim 9, wherein the wash pipe comprises an internal retaining element to retain cuttings.

14. The assembly of claim 9, wherein the guide bar comprises a metal or metal alloy having a material yield strength equal or less than the whipstock material.

15. A system for milling a window for a lateral wellbore in a casing string, the system comprising:

a milling assembly comprising:

a whipstock, a guide bar coupled to the whipstock, a wash pipe coupled to the guide bar; wherein the guide bar is coupled to the wash pipe with an acuatable connection comprising hydraulics, pneumatics, or a combination thereof;

a casing string having the milling assembly disposed therein, wherein the casing string comprises a desired location for a window, wherein the location is adjacent the milling assembly.

16. The system of claim 15, wherein the window is not pre-milled and does not comprise a pilot hole.

17. The system of claim 15, wherein the guide bar is offset from the whipstock.

18. The system of claim 15, wherein the wash pipe comprises an internal retaining element to retain cuttings.

19. The system of claim 15, wherein the guide bar is coupled to the wash pipe proximate a terminal end of the guide bar, wherein said terminal end of the guide bar is chamfered.

20. The system of claim 15, wherein the guide bar comprises a metal or metal alloy having a material yield strength equal or less than the whipstock material.

* * * * *